United States Patent [19]

Flanagan et al.

[11] Patent Number: 4,961,380

[45] Date of Patent: Oct. 9, 1990

[54] ENERGETIC AZIDO EUTECTICS

[75] Inventors: Joseph E. Flanagan, Woodland Hills; Dean O. Woolery, II, Reseda, both of Calif.

[73] Assignee: Rockwell International Corporation, El Segundo, Calif.

[21] Appl. No.: 160,879

[22] Filed: Feb. 26, 1988

[51] Int. Cl.[5] ..... C06D 5/06

[52] U.S. Cl. ..... 102/287; 102/291; 149/19.92

[58] Field of Search ..... 102/285, 287, 291; 149/19.92, 92

[56] References Cited

U.S. PATENT DOCUMENTS

| | | | |
|---|---|---|---|
| 4,098,627 | 7/1978 | Tompa et al. | 149/19.92 X |
| 4,165,247 | 8/1979 | Brew et al. | 149/19.6 X |
| 4,427,466 | 1/1984 | Flanagan et al. | 149/92 |
| 4,450,110 | 5/1984 | Simmons et al. | 260/349 |
| 4,761,250 | 8/1988 | Frankel et al. | 149/92 X |

*Primary Examiner*—Peter A. Nelson

*Attorney, Agent, or Firm*—H. Fredrick Hamann; Harry B. Field; David C. Faulkner

[57] ABSTRACT

A low freezing point eutectic solid propellant plasticizer composition component comprising a mixture of 1,5-dinitrato-3-nitrazapentane and 1,5-diazido-3-nitrazapentane having a eutectic freezing point below about −25° C.

7 Claims, No Drawings

ENERGETIC AZIDO EUTECTICS

BACKGROUND OF THE INVENTION

1. Field of the Invention

This invention relates to propellants and is particularly directed to solid propellant formulations employing a low freezing point eutectic solid propellant component comprising a mixture of 1,5-dinitrato-3-nitrazapentane (DINA) and 1,5-diazido-3-nitrazapentane (DANPE).

2. Description of Related Art

Solids propellants are generally formulated to include solid oxidizers and fuels, together with suitable polymers and plasticizers to impart physical integrity. To enhance the propellant integrity, particularly in low temperature environments such as outer space or arctic conditions, the physical properties of the propellant system may be modified to influence the glass transition point.

The use of nitrato plasticizers containing the energetic —$ONO_2$ group such as nitroglycerin have been utilized to impart additional energy to propellants. Unfortunately, many of the known nitrato compounds used as plasticizers limit the utilization of the range of propellant composition.

SUMMARY OF THE INVENTION

Accordingly there is provided by the present invention an energetic azido eutectic propellant composition component comprising a plasticizer mixture of 1,5-dinitrato-3-nitrazapentane (DINA) and 1,5-diazido-3-nitrazapentane (DANPE) having a eutectic freezing point below about −25° C. When combined in a propellant composition including oxidizers such as 1,3,5-trinitrazacyclohexane (RDX) 1,3,5,7-tetranitrazacyclooctane (HMX), and ammonium perchlorate (AP) a polymer such as glycidyl azide polymer (GAP) with a fuel such as aluminum, a solid propellant having enhanced performance characteristics at low temperatures results.

DESCRIPTION OF THE DRAWING

A freezing point diagram for utectic propellant component mixtures according to the present invention as represented in the Figure.

OBJECTS OF THE INVENTION

Therefore it is an object of the present invention to provide an improved formulation for solid propellants.

Yet another object of this invention is to provide plasticizer compositions for solid propellants which enhance the low temperature performance thereof.

These and other objects and features of the present invention will be apparent from the following detailed description.

DETAILED DESCRIPTION OF THE INVENTION

In accordance with the present invention there is provided a solid propellant compostion including an oxidizer blend of HMX and AP, a polymer such as glycidyl azide polymer (GAP), and a fuel such as aluminum, to which is blended a low freezing point eutectic solid propellant composition plasticizer component according to the present invention.

It has been found that a solid propellant composition incorporating the low freezing point eutectic solid propellant plasticizer component of the present invention results in a propellant composition having equivalent specific impulse (Isp) to a nitroglycerin based system as shown in Table 1:

TABLE 1

| Theoretical Solid Propellant Performance | |
|---|---|
| Composition (Wt. %) | Isp (1000 → 14.7), sec. |
| 10.0 GAP/10.0 NG/10.0Al/13.4 AP/56.6 HMX | 271.2 |
| 10.0 GAP/10.0 Eutectic*/10.0 Al/12.2 AP/57.8 HMX | 271.1 |

*50/50 (DANPE:DINA)

The eutectic propellant component of the present invention is prepared by dissolving solid DINA (MP 52° C.) into liquid DANPE (MP 8° C.). More particularly, homogeneous liquid mixtures consisting of 50% DINA-50%-DANPE and 29% DINA-71% DANPE result in compositions having unusually low freezing points of about −25° C. and about −55° C. respectively as shown in the Figure. Another preferred solid propellant composition includes a eutectic plasticizer propellant component consisting of 37.5 percent (DINA) / 63.5 percent (DANPE).

Obviously, numerous variation and modifications may be made without departing from the present invention. Accordingly, it should be clearly understood that the form of the present invention described above is illustrative only and is not intended to limit the scope of the present invention.

What is claimed and desired to be secured by Letters Patent of the United States is:

1. In a solid propellant composition including an oxidizer, plasticizer, polymer and fuel, the improvement comprising a low freezing point eutectic solid propellant plasticizer composition component further comprising a mixture of 1,5-dinitrato-3-nitrazapentane and 1,5-diazido-3-nitrazapentane having a eutectic freezing point below about −25° C.

2. The solid propellant composition of claim 1 wherein the low freezing point eutectic solid propellant plasticizer composition component comprises a mixture of about 50% 1,5-dinitrato-3-nitrazapentane and about 50% 1,5-diazido-3-nitrazapentane.

3. The solid propellant plasticizer composition of claim 1 wherein the low freezing point eutectic solid propellant composition component comprises a mixture of about 37.5% 1,5-dinitrato-3-nitrazapentane and about 63.5% 1,5-diazido-3-nitrapentane.

4. A solid propellant composition including an oxidizer blend of HMX and AP, a plasticizer composition component comprising a mixture of 1,5-dinitrato-3-nitrazapentane and 1,5-diazido-3-nitrazapentane having a eutectic freezing point below about −25° C., GAP and an aluminum fuel.

5. A solid propellant composition comprising an oxidizer blend of 57.8 weight percent HMX and 12.2 weight percent AP, 10.0 weight percent of a 50/50 blend of DANPE:DINA plasticizer.

6. The solid propellant composition of claim 5 wherein the plasticizer comprises a 10.0 weight percent of a 63.5 weight percent/37.5 weight percent blend of DANPE:DINA.

7. The solid propellant composition of claim 5 wherein the plasticizer comprises a 10.0 weight percent of a 71.0 weight percent/29.0 weight percent blend of DANPE:DINA.

* * * * *